US007025520B2

(12) United States Patent
Petit

(10) Patent No.: US 7,025,520 B2
(45) Date of Patent: Apr. 11, 2006

(54) SAMPLE DISTRIBUTOR FOR A SOLID, SEMI-SOLID OR PASTY PRODUCT

(75) Inventor: Robert Petit, Savlgny sur Orge (FR)

(73) Assignee: Techpack International, Chevilly-Larue (FR)

( * ) Notice: Subject to any disclaimer, the term of this patent is extended or adjusted under 35 U.S.C. 154(b) by 61 days.

(21) Appl. No.: 10/682,878

(22) Filed: Oct. 14, 2003

(65) Prior Publication Data

US 2004/0074805 A1 Apr. 22, 2004

(30) Foreign Application Priority Data

Oct. 14, 2002 (FR) ..... 02 12748

(51) Int. Cl.

| | |
|---|---|
| ***B43K 23/00*** | (2006.01) |
| ***B43K 23/02*** | (2006.01) |
| ***A45D 40/20*** | (2006.01) |
| ***D65D 21/00*** | (2006.01) |

(52) U.S. Cl. ..... 401/98; 401/88; 401/131; 206/504; 206/508

(58) Field of Classification Search ..... 401/49, 401/88, 98, 131; 206/515, 581, 503, 504, 206/508

See application file for complete search history.

(56) References Cited

U.S. PATENT DOCUMENTS

| | | | | |
|---|---|---|---|---|
| 2,663,450 | A | 12/1953 | Bourcart | |
| 2,695,115 | A * | 11/1954 | Roop | 220/802 |
| 4,621,935 | A | 11/1986 | Sussman | |
| 4,728,210 | A * | 3/1988 | Barish et al. | 401/6 |
| 4,915,234 | A | 4/1990 | Boeller | |
| 4,950,094 | A | 8/1990 | Yorks | |
| 5,046,875 | A * | 9/1991 | Skolnik | 401/49 |
| 5,092,700 | A | 3/1992 | Susini et al. | |
| 5,738,123 | A * | 4/1998 | Szekely | 132/318 |
| 6,193,427 | B1 * | 2/2001 | Benguigui | 401/88 |
| 6,745,900 | B1 * | 6/2004 | Lambert | 206/581 |

FOREIGN PATENT DOCUMENTS

| | | |
|---|---|---|
| EP | 1 068 817 | 1/2001 |
| GB | 2 351 726 | 1/2001 |

* cited by examiner

*Primary Examiner*—David J. Walczak
(74) *Attorney, Agent, or Firm*—Young & Thompson

(57) ABSTRACT

A distributor includes a body, typically provided with a lateral skirt and a bottom, and a cap, provided with an inner dome. The body includes at least one orifice for filling a cavity with the product, a device for closing the orifice, a device for attaching the product to the body, and a lower skirt forming a lower cavity with the bottom, capable of cooperating with the cap so as to form a system for stacking the distributor.

24 Claims, 6 Drawing Sheets

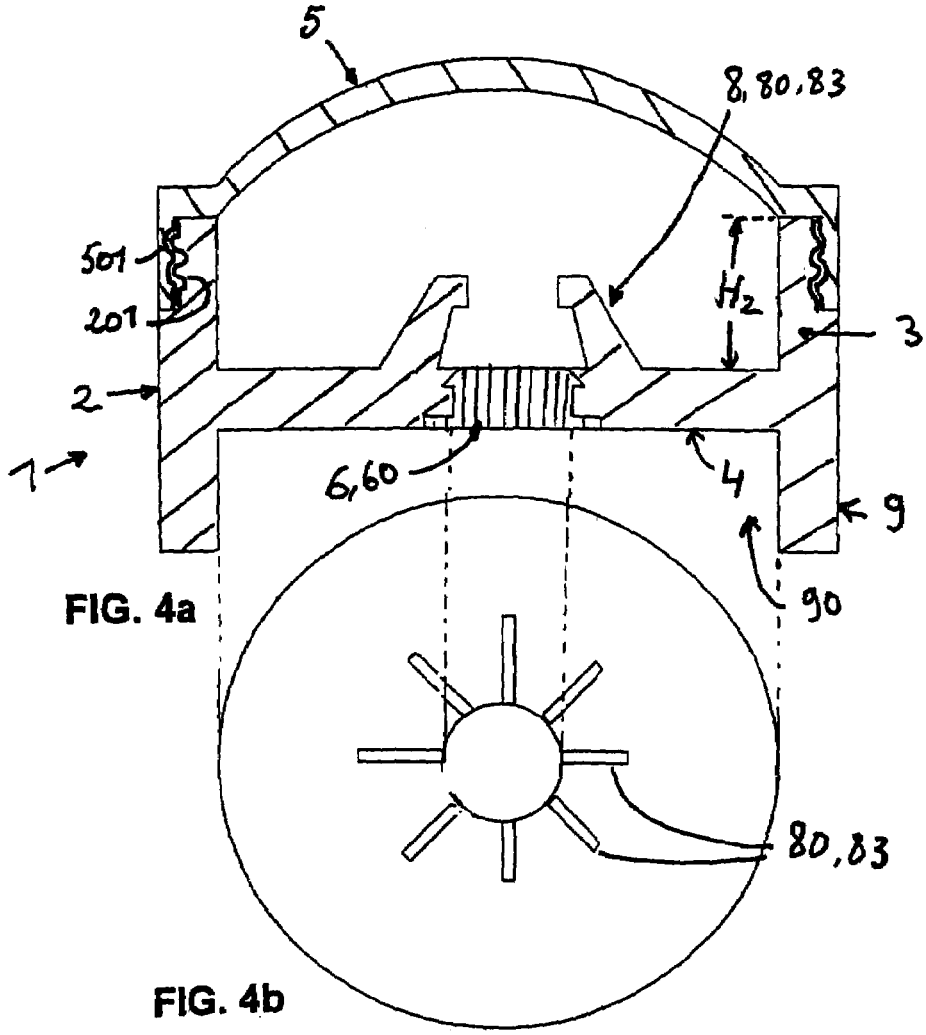
FIG. 4a
FIG. 4b
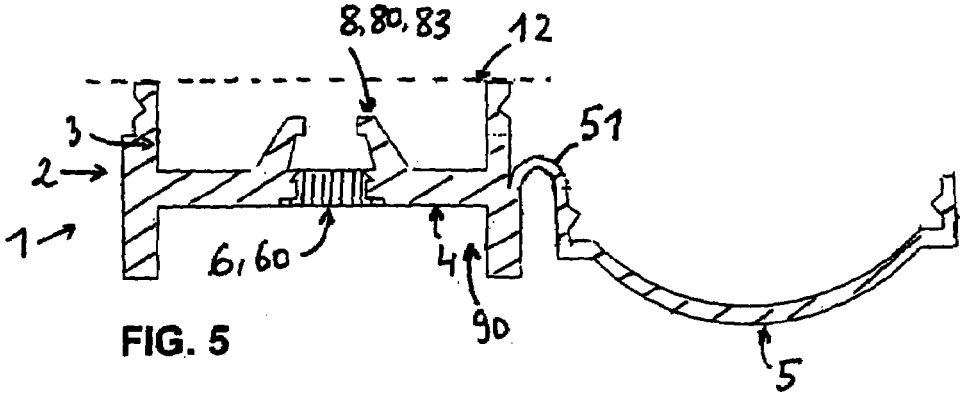
FIG. 5

SAMPLE DISTRIBUTOR FOR A SOLID, SEMI-SOLID OR PASTY PRODUCT

FIELD OF THE INVENTION

The invention relates to the field of packagings or distributors of solid, semi-solid or pasty cosmetic products.

More particularly, it relates to sample packagings usually distributed free of charge to potential customers.

STATE OF THE ART

Many packagings for solid, semi-solid and pasty cosmetic products are already known.

These packagings usually comprise product propulsion means, these products not being liquid at the ambient temperature of use. Examples include a deodorant stick or a tube of lip cream.

Sample packagings are also known for these same products. These sample packagings do not include propulsion means, firstly because the presence of a propulsion means would not be justified to the extent that a sample corresponds to a small quantity of the sampled product to be tested, and secondly because the cost of a propulsion means would be too high for a sample packaging that is typically free of charge.

Thus, European patent application No. 1 068 817 describes a container for skin care, hygiene and body makeup products used for providing samples of these products.

Problems that Arise

One problem related to the container according to the prior art is its cost, in that it includes three parts with high material costs; there is a base forming the container body, a cap, an inner dish assembled to the base and possibly a removable cover used to obtain a moulded product.

An additional problem is that these containers are not stackable.

Another problem is due to the fact that a removable cover has to be present in order to obtain a moulded product.

The purpose of this invention is to obtain a sample distributor that solves these problems, and other problems that will be presented in the description of the invention.

Finally, there is a permanent demand for new products, particularly in the field of packagings for cosmetic products. The invention is also aimed at satisfying this demand.

DESCRIPTION OF THE INVENTION

According to the invention, the distributor, typically for offering a sample of a product that may be solid, semi-solid or pasty at ambient temperature, comprises a body typically provided with a lateral skirt and a bottom, and a cap, typically provided with an inner dome, cooperating reversibly with the said body through a solidarisation means, and closing the said body so as to form a cavity with an inner volume V, and is characterised in that:

a) the said body comprises an orifice for filling the said cavity with the said product, typically from below the said body, such that, the said cap being made integral to the said body, typically in the closed position, and the said distributor being typically upside down, the said distributor can be filled with product, the said product typically having been made liquid in advance by heating it above the said ambient temperature, b) the said body comprises a means of closing the said orifice, c) and the said body comprises a means of attaching the said product to the said body, such that the said solid, semi-solid or pasty product at ambient temperature forms a cake or block fixed to the said body, even after separation of the said cap, and that can be applied to a support, typically the skin, the said cake or block being moulded by the said dome, d) the said body typically comprises a lower skirt forming a lower cavity with the said bottom, capable of cooperating with the said cap so as to form a means for stacking the said distributor.

The distributor according to the invention solves the problems that arise.

Firstly, this distributor can be made with a limited number of parts: with two moulded parts, one to form the body provided with the means of attaching and closing the said orifice, and one to form the said cap. But the said distributor can be moulded in a one-piece part, the said cap being connected to the said body through a flexible tab. Thus, a very economical distributor can be obtained.

Secondly, this distributor enables vertical stacking and therefore a presentation or storage of these distributors only occupies a small footprint.

Apart from the fact that these distributors can be used for many different practical applications, a high percentage of recuperation of the packaged product can be obtained.

DESCRIPTION OF THE FIGURES

All figures are related to the invention.

All figures except for FIGS. 3*b* and 4*b* are total or partial axial sections through distributors (1), along the axis (10) of the distributor (see FIG. 1), FIGS. 3*b* and 4*b* being partial views or sections in a horizontal plane perpendicular to the axis (10).

A variant of the distributor is shown in dotted lines in which the bottom (4) is convex instead of being concave, which reduces the storage capacity but facilitates access to the product.

Figure 1A:
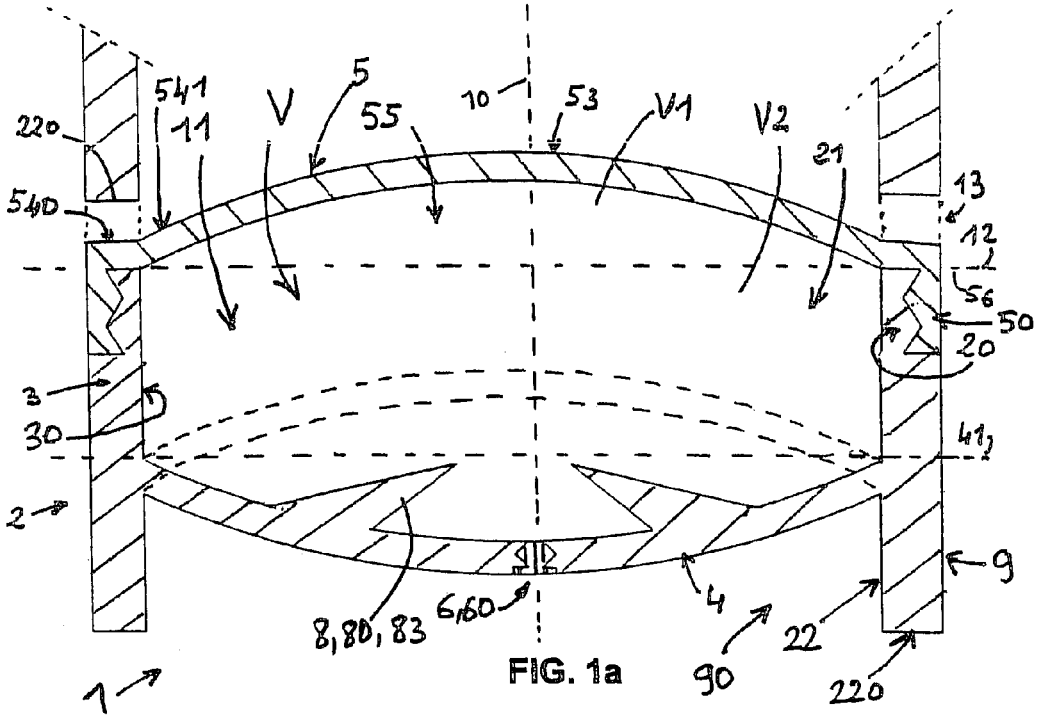
FIG. 1*a* represents an embodiment of the distributor (1) in which the said body (2), due to its volume V2>>V1, forms the main part of the storage capacity of the said distributor, and in which the said attachment means (8, 80) is fixed to the said bottom (4) and forms a one-piece part with the said bottom (4).
Figure 1B:
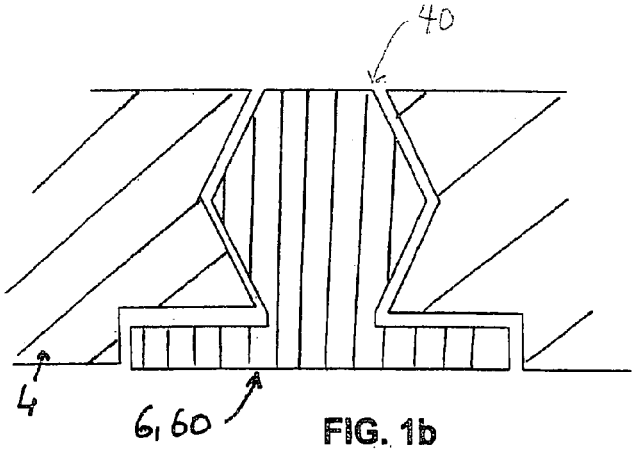

FIG. 1*b* is an enlarged view of the orifice (40) of the bottom (4) and its closing cap (60) click fitted into the said orifice.

Figure 2A:
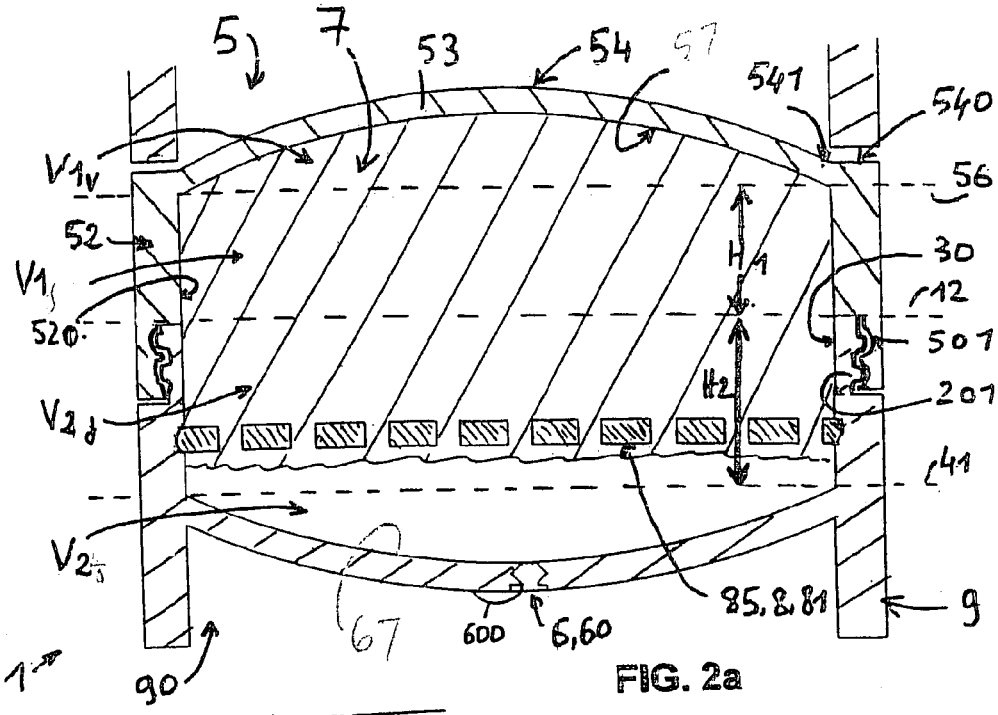
Figure 2B:
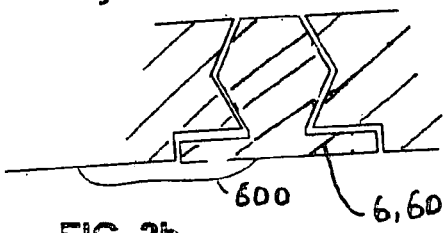

FIGS. 2*a* and 2*b*, similar to FIGS. 1*a* and 1*b*, illustrate an embodiment of the distributor (1) in which the said body (2) due to its volume V2, and the said cap (5) due to its volume V1, each accounts for substantially equal parts of the storage capacity of the said distributor, and in which the said closing cap (60) is connected through a tab (600) to the said bottom (4), either because the said cap (60) forms a one-piece part with the said bottom, or because the said tab typically formed with the said cap (60) is sealed to the said bottom (4) at one of its ends.

Figure 2C:
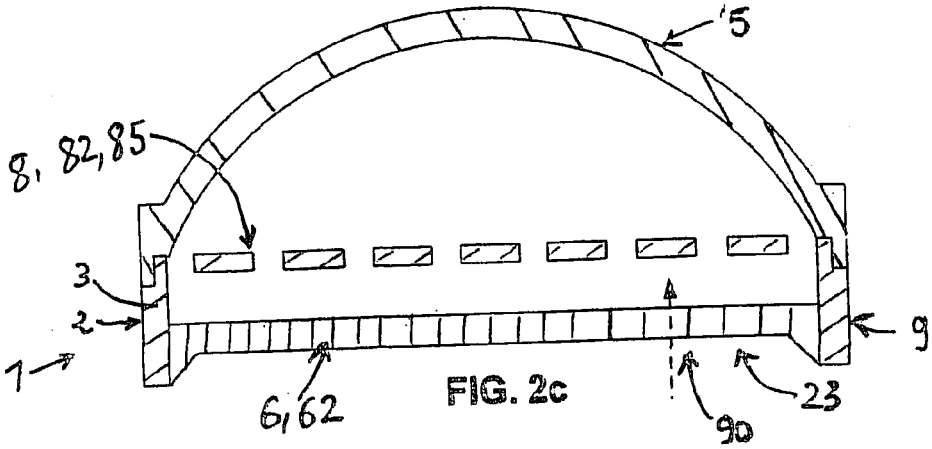

FIG. 2*c* illustrates the case of a distributor (1) without a bottom (4), in which the tubular body (2) forms a lower opening (23) closed by a cap (62), possibly forming a piston for the said tubular body, and in which the said attachment means (8) is a mesh (85), forming a one-piece part with the said body (2).

Figure 3A:
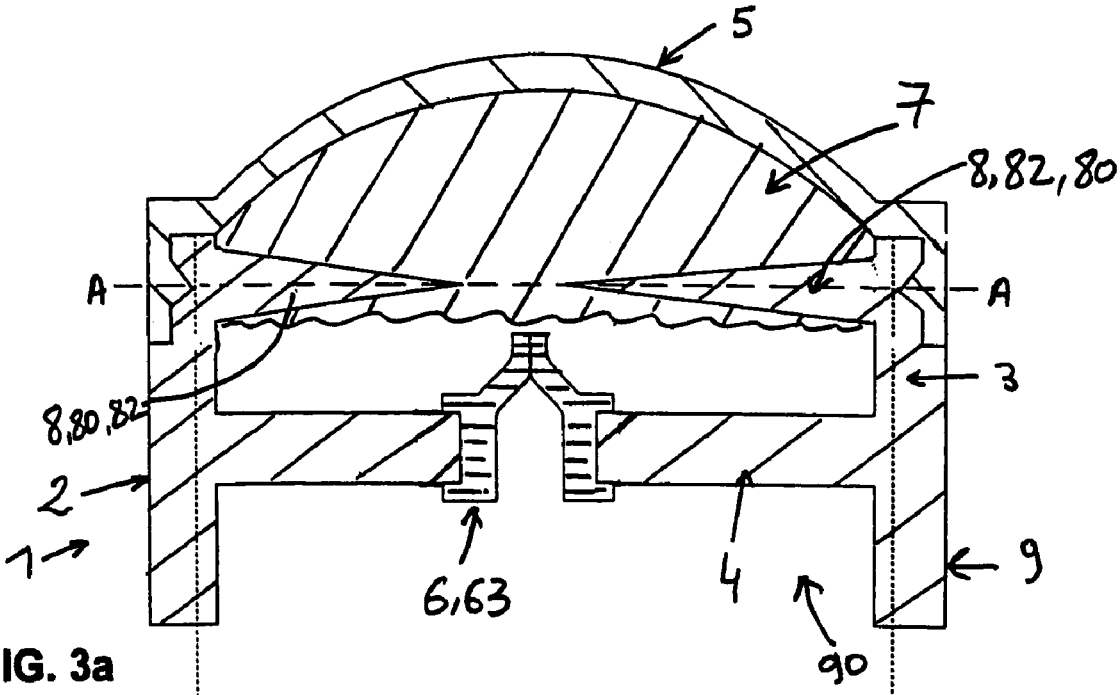
Figure 3B:
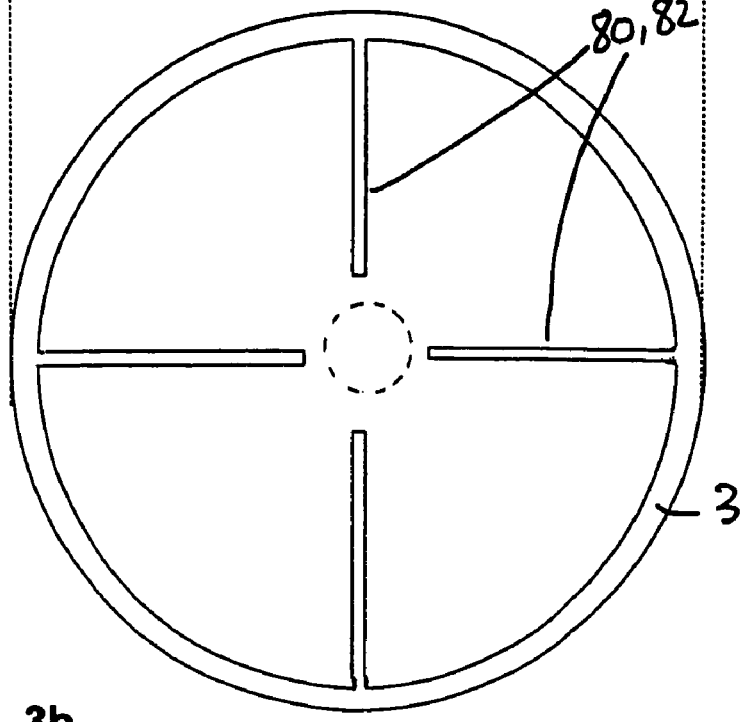

FIGS. 3*a* and 3*b* relate to an embodiment of the distributor (1) in which the said attachment means (8) forms a one-piece part with the lateral skirt (3) of the body (2) and in which the said closing means (6) is an elastomer valve (63).

FIG. 3*b* corresponds to a section of the body (2) along the horizontal plane A—A in FIG. 3*a*.

FIG. 4*a* is similar to FIG. 1*a* and illustrates a variant of the distributor (1) in which in particular, the cap (5) is screwed into the body (2) with a thread (201, 501).

FIG. 4*b* is top view of the bottom (4) showing the arrangement of the 8 tabs (80, 83).

FIG. 5 illustrates the case of a distributor (1) in which the said cap (5) and the said body (2) form a one-piece part, a flexible connecting tab (51) leaving the cap (5) free to move with respect to the body (2).

Figure 6:
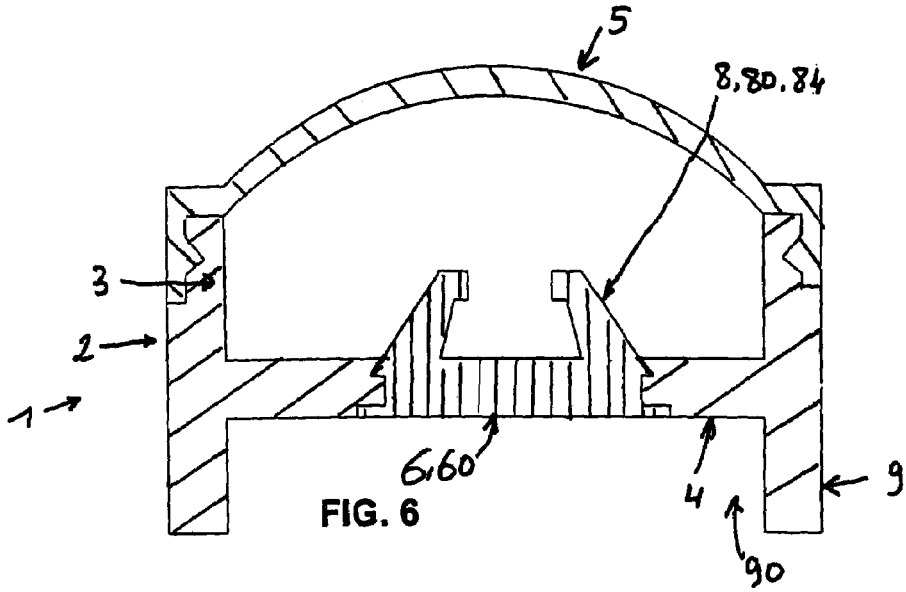

FIG. 6, similar to FIG. 4*a*, illustrates the case of a distributor (1) in which the attachment means (8) is formed by tabs (80, 84) fixed to the cap (60).

Figure 7:
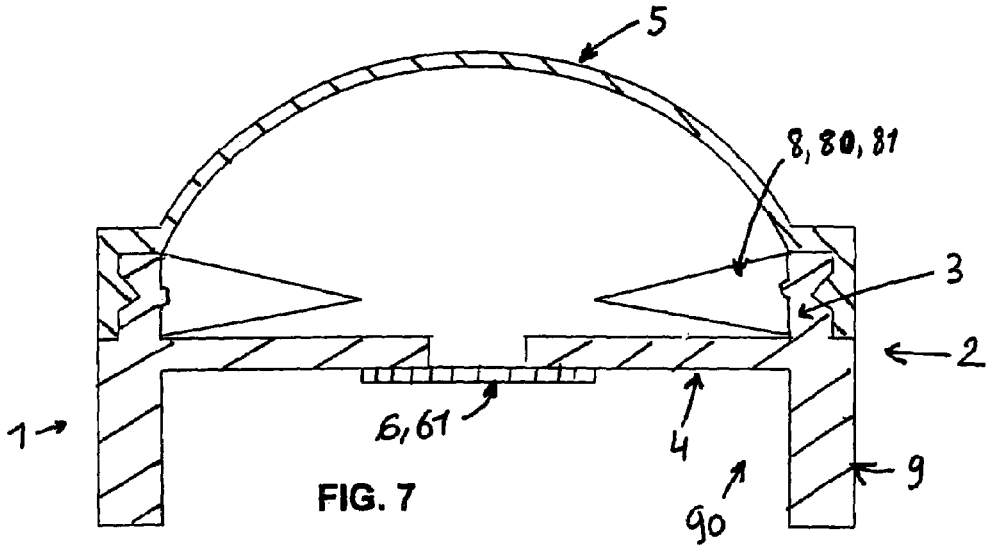

FIG. 7, similar to FIG. 3*a*, illustrates the case of a distributor (1) in which the attachment means (80) is an insert (81), and in which the said closing means (6) is a heat-sealed disk (61).

Figure 8:
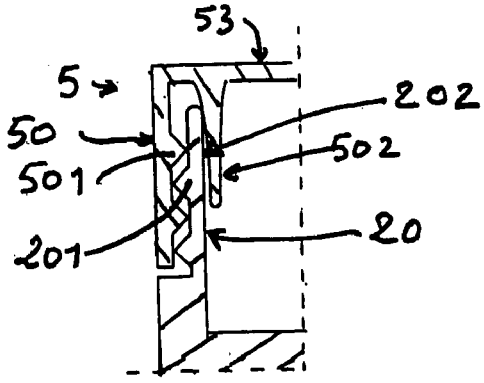

FIG. 8 shows a partial sectional view (top left part of the distributors) of a typically leaktight method by which the cap (5) and the solidarisation edge (20) of the body (2) cooperate, particularly due to an inner lip (502).

Figure 9:
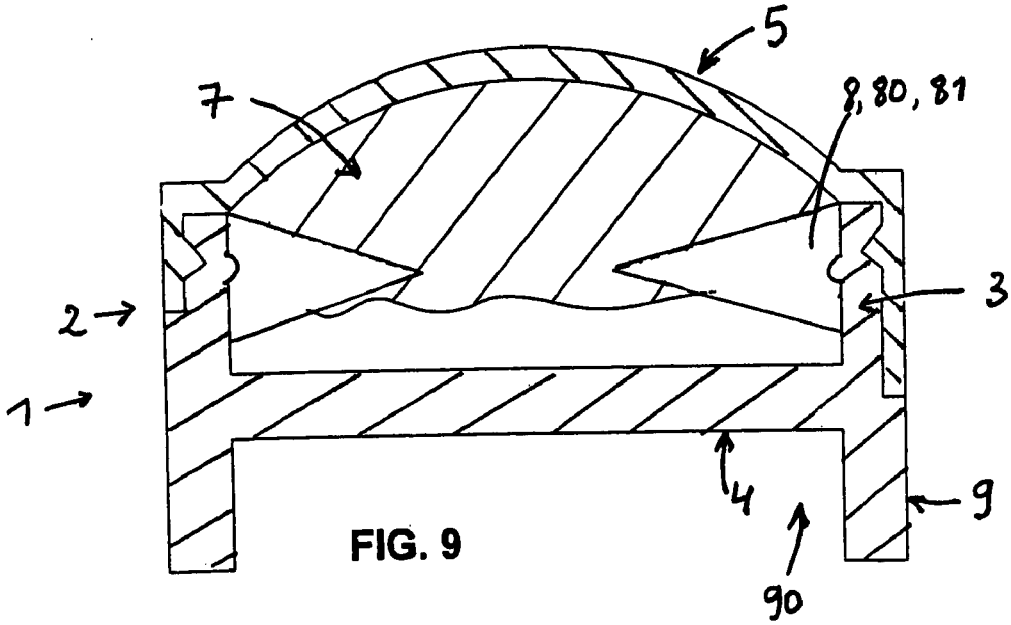

FIG. 9 shows a partial section view of a further embodiment of the invention

DETAILED DESCRIPTION OF THE INVENTION

According to the invention, the said inner volume V of the distributor (1) may be formed from an inner volume V1 corresponding to a cavity (55) in the said cap (5) and an inner volume V2 corresponding to a cavity (21) in the said body (2), the inner volume V=V1+V2 typically being between 2 and 50 $cm^3$ in the case in which the said distributor is a sample distributor, but this volume could typically be up to 200 $cm^3$ if the purpose is not to distribute samples of the product (7).

There can be a relation V1=a.V2 between these two volumes V1 and V2, the coefficient a typically varying from 0.3 to 3, such that the cavity (55) in the said cap (5) can mould a predetermined fraction by volume of the said product (7).

It may be advantageous if most of the product (7) is located in the volume V1 of the cap, so that it becomes accessible and easy to apply directly and so that a large proportion of the said product is actually usable.

As illustrated in FIG. 1*a* by way of example, the cavity (11) of volume V formed by the said closed distributor (1) typically comprises the cavity (21) of volume V2 formed by the body (2) and the cavity of volume V1 formed by the cap (5), the opening plane (12) forming the demarcation line between the two volumes.

Typically, the said body (2) and the said cap (5) may each include a solidarisation edge (20, 50). In this case, the said solidarisation means may be formed by cooperation of the said solidarisation edges (20, 50), the said solidarisation edges (20, 50) typically cooperating such that the thickness of the said solidarisation means when the distributor (1) is closed is approximately the same as the thickness of the said skirt (3).

According to the invention, the said solidarisation means may be formed by click fitting (for example see FIGS. 1*a*, 3*a*, 6 and 7), or by a tight sliding fit (see FIG. 2*c*) of the said solidarisation edges, or by screwing (see FIGS. 2*a*, 4*a* and 8) with a threaded edge or a thread (501) of the said cap (5) cooperating with a threaded edge or a thread (201) of the said body (2), the said threaded edge (501) of the said cap (5) typically being outside the said threaded edge (201) of the said body (2).

Screwing will be preferred as the solidarisation means in the case in which the cap (5) comprises a skirt (52), so as to avoid any risk of the said product being entrained with the said cap when the said distributor is opened.

However, the invention is not limited to the solidarisation means described explicitly above or in the figures, since these are simply examples.

As illustrated in FIG. 5, the said body (2) and the said cap (5) can form a one-piece part due to a flexible connecting tab (51) making the said cap (5) integral to the said body (2).

According to the invention, the said closing means (6) may typically be chosen from among a glued or heat-sealed disc or seal (61)—see FIG. 7, a closing cap (60, 62) typically click fitted or with a tight sliding fit or screwed to the said orifice (see FIGS. 1*a*, 1*b*, 2*a*, 2*c*, 4*a*, 5 and 6), or a non-return valve (63) typically made of an elastomer and with flexible lips (see FIG. 3*a*).

According to one embodiment of the invention illustrated on all the figures, except for FIG. 2*c*, the said body (2) may include a bottom (4) and typically a lateral skirt (3) of height H2 (see, e.g., FIG. 2*a*) and typically straight, the said bottom (4) being either plane, or convex, or concave, the said bottom (4) thus being capable of modulating the volume V2 of the said cavity (21), to reduce it or increase it by a volume depending on whether the bottom surface (67) is convex or concave.

Concerning the said lateral skirt (3), note that the height H2 may be variable and in particular, as illustrated in FIG. 7, it may be reduced to the height necessary to obtain an attachment means (8) located below the said opening plane (12). But the invention illustrates the case that is not shown in the figures but can easily be deduced from FIG. 7, in which the said body (2) does not include a skirt (3), and consequently the said typically flexible attachment means is located above the said opening plane (12).

The said straight lateral skirt (3) can make a volume contribution V2j equal to not more than H2 times the section area in the case of a plane or concave bottom (4), where H2 denotes the height of the said lateral skirt (3) and the section area is the area of the section of the said lateral skirt (3).

Similarly, see, e.g., FIG. 2*a*, concerning the said cap (5), it may comprise a skirt (52) of height H1 and a dome (53), with an inner surface (57), that may be either plane or concave or convex as seen from the inside, such that the said dome (53) makes zero contribution to the volume V2 of the said cavity (21) in the case of a plane or convex dome, or a contribution equal to V1*v* in the case of a concave dome, where V1*v* is the volume defined by the said concave dome (53).

The skirt (52) is typically straight, and can make a volume contribution V1*j* typically equal to H1 times the section area, where the section area is the area of the section of the said skirt (52) or the lateral skirt (3).

These different volumes V1*v*, V1*j*, V2*j* and V2*f* are shown in FIG. 2*a*, knowing that V1=V1*v*+V1*j*, and V2=V2*f*+V2*j*, and V=V1+V2.

As illustrated on all the figures, it is advantageous according to the invention if the said cap (5) comprises an upper profile (54) and if the said body comprises a lower profile (22), the said upper profile (54) and lower profile (22) being chosen to be capable of cooperating in the axial direction such that the said distributor (1) is stackable and is thus capable of forming a stable stack.

To achieve this, and as illustrated particularly clearly in FIG. 1*a*, and in order to form the said stable stack:

a) the said cap (5) of the said distributor (1) may comprise an upper peripheral edge (540) and the said body (2) comprises a lower peripheral edge (220), the said lower edge (220) typically forming an axial projection (13) of the said upper edge (540), such that the weight of the distributors of the said stack is transmitted through the said typically plane and narrow peripheral edges, so that a stable stack of distributors (1) can be formed, b) preferably, the said cap comprises a shoulder (541), possibly forming part of the said dome (53), chosen to prevent any radial displacement of the lower peripheral edge (220) of the body of the distributor placed above it in the said stack, so as to avoid any risk of lateral or radial sliding of a distributor (1) from the said stack.

According to the invention, the said attachment means (8) may be formed by outgrowths (82, 83) from the said body (2), or by outgrowths (84) from the said closing means (6), or by an insert (81) typically made integral to the said body, the said outgrowths (82, 83, 84) or the said insert (81), the said outgrowths or the said insert typically comprising attachment tabs (80).

The term "outgrowths" of a part means that the said attachment means forms a one-piece part with the said part.

Thus in FIGS. 1*a* and 4*a*, the tabs (80) are outgrowths (83) from the bottom (4).

In FIG. 3*a*, the tabs (80) are outgrowths (82) from the skirt (3).

In FIG. 6, the tabs (80) are outgrowths (84) from the closing means (6).

Typically, and as illustrated in the figures, the said outgrowths (82, 83, 84) may be included within the said cavity (21) and therefore contained within the said volume V2 when V2>0, so that they cannot come into contact with the said support during application of the said product (7).

The said attachment tabs (80) may be either rigid or flexible.

Concerning the said flexible tabs (80), they may be obtained either by choosing thin tabs or by choosing a material with a low bending modulus to form the said tabs, so as to make it possible for the said cake or block of product (7) to be applied directly, typically to the skin, even when the said flexible tabs forming the said attachment means are located in part above the said opening plane (12) and are therefore likely to come into contact with the skin, and thus increase the recuperation ratio of the said product, since all or some of the product located between the said flexible tabs can be applied to the skin, and the said tabs can also possibly provide a means of spreading the said product on the skin, like a flexible spatula.

In this case, these flexible tabs would be fully or partly located above the said opening plane (12).

According to another embodiment of the invention and as illustrated in FIGS. 2*a* and 2*c*, the said attachment means (8) may consist of a mesh (85), typically perforated with several orifices distributed over its entire surface.

According to one variant of the invention and as illustrated in FIGS. 2*a*, 7 and 9, the said attachment means (8) may form an insert (81) that can typically be click fitted into the said body (2).

In the case shown in FIG. 2*a*, the said insert (81) is formed from a mesh (85) whereas it comprises tabs (80) in the case of FIGS. 7 and 9.

As already mentioned, the said attachment means (8) may form a one-piece part moulded with the said closing means (6), or the said body (2), the said bottom (4) or the said lateral skirt (3).

The said moulded part is typically made of polyolefin, PE or PP.

As illustrated in FIG. 8, the said cap (5) may comprise an inner lip (502) typically connected with the said dome (53) cooperating in a typically leaktight manner with an inner rim (202) of the said solidarisation edge (20).

According to another embodiment of the distributor (1) according to the invention illustrated in FIG. 9, it is possible that the said body (1) does not include any orifice (40) or lower opening (23) or closing means corresponding to the said orifice (6); the said body (2) can form a cavity (21) with a volume equal to at least V/2, the said attachment means (8) typically being placed immediately below a so-called opening plane (12) of the said body (2), so that the said distributor (1) can be filled or refilled through the top, the said cap (5) being removed, the said cavity (21) typically being filled during the said loading operation with product in the liquid state, and thus after having put the said cap closing the said body and the said dish into position, and after turning the said distributor over before the said product has solidified, so as to obtain the said product fixed to the said body by the said attachment means, and moulded due to the said dome.

However, it would also be possible to use an attachment means (8) comprising flexible tabs (80) that could be located above the said opening plane (12).

According to another embodiment of the invention illustrated in FIG. 2*c*, the said body (2) does not necessarily have a bottom (4), the said attachment means (8) and the said body (2) typically being able to form a one-piece part and the said body (2) may comprise a lower opening (23) in substitution of the said orifice (40), the said closing means (6) typically being a closing cap (62), possibly capable of sliding into the said body (2) like a piston, under the action of manual pressure.

In FIG. 2*c* the attachment means (8) was represented by a mesh (85), but the said mesh could have been replaced by fins (80).

As illustrated for example in FIG. 2*a*, the said cap (5) may comprise a skirt (52), the said skirt (52) having an inner surface (520) which extends the inner surface (30) of the said skirt (3) of the said body, and the said dome (53) of the said cap (5) may be connected to the said skirt (52) of the said cap (5) or the said body (2), such that the said product (7) moulded in the said cavity forms a block with its head moulded by the said dome.

Another purpose of the invention consists of using the said distributor (1) according to the invention for packaging cosmetic products (7) in the form of cakes such as a deodorant, soap, a body care cream, a pasty or solid foundation, and particularly for packaging samples of these cosmetic products.

Exemplary Embodiments

All figures show exemplary embodiments.

Thus, PE and PP parts were moulded to make distributors (1) according to FIGS. 1*a* to 9 with a capacity or volume V of 5, 10 and 25 $cm^3$ to form sample distributors.

For the distributor (1) in FIG. 2*c*, distributors (1) with a capacity of 200 $cm^3$ were made.

Advantages of the Invention

The invention has many advantages. Apart from the fact that it makes it possible to solve problems encountered with distributors according to the state of the art, firstly it enables economical manufacturing of the said distributors, and secondly it makes it possible to use a large number of practical embodiments of distributors, which is an advantage considering the need to personalise cosmetic product packaging. Finally, the invention can be used for manufacturing low capacity sample distributors that are usually distributed free of charge, or for distributors with a larger capacity.

| List of marks | |
|---|---|
| Sample distributor | 1 |
| Vertical axis | 10 |
| Cavity = 21 + 55 | 11 |
| Opening plane | 12 |
| Axial outgrowth of 220 on 540 | 13 |
| Body | 2 |
| Solidarisation edge to 5 | 20 |
| Thread cooperating with 501 | 201 |
| Inner rim | 202 |
| Cavity | 21 |
| Lower profile | 22 |
| Lower peripheral edge | 220 |
| Lower opening | 23 |
| Lateral skirt of 2 and 21 | 3 |
| Inner surface | 30 |
| Bottom of 2 | 4 |
| Orifice | 40 |
| Bottom plane | 41 |
| Cap | 5 |
| Solidarisation edge to 2 | 50 |
| Thread cooperating with 201 | 501 |
| Inner lip | 502 |
| Connecting tab to 2 | 51 |
| Skirt | 52 |
| Inner surface | 520 |
| Dome | 53 |
| Upper profile | 54 |
| Upper peripheral edge | 540 |
| Shoulder | 541 |
| Cavity | 55 |
| Dome plane | 56 |
| Means of closing 40 or 23 | 6 |
| Closing cap (click fitted) | 60 |
| Connecting tab | 600 |
| Heat-sealed seal | 61 |
| Cap for 23 | 62 |
| Valve | 63 |
| Product | 7 |
| Means of attaching 7 to 2 | 8 |
| Attachment tab | 80 |
| Click fit insert in 2 or 3 | 81 |
| Outgrowth from 3 | 82 |
| Outgrowth from 4 | 83 |
| Outgrowth from 6 | 84 |
| Mesh | 85 |
| Lower skirt | 9 |
| Lower cavity | 90 |

The invention claimed is:

1. Distributor (1) for offering a sample of a solid, semi-solid or pasty product (7) at ambient temperature, comprising:

a molded, one-part body (2) having i) a small orifice (40) located at a bottom of the body, ii) a straight vertical body lateral skirt (3), of a first wall thickness, terminating at an upper end with a body solidarisation edge (20), and iii) a lower peripheral edge (220);

a molded, one-part cap (5) having i) a straight vertical cap lateral skirt (52) terminating at a lower end with a cap solidarisation edge (50), ii) an upper peripheral edge (540), and iii) a dome (53), the cap attachable to the body by the cap solidarisation edge cooperating joining with the body solidarisation edge to jointly form a wall thickness equal to the first wall thickness of the body, the body lateral skirt and the cap lateral skirt, when joined, cooperating to provide a closed distributor with a straight external wall surface free of external protrusions;

a cavity located within the cap attached to the body, the cavity providing a product volume space (V), the product volume space being defined by, at an upper end by an inner surface (57) of the dome of the cap, at a lower end by an inner surface (67) of the bottom of the body, and at straight cylindrical internal sidewall surfaces (520, 30), by an inner sidewall surface of the body lateral skirt and any inner sidewall surface of the cap lateral skirt, the body comprising attachment parts (8) for attaching the product (7) to the body; and a closing element (6) closing the orifice to retain the product within the cavity, the closing element being one of a insert (6, 60, 63) inserted into the cavity and a cover (6, 61) covering the orifice, wherein, with the cap solidarisation edge joined to the body solidarisation edge, the body is joined to the cap and forms the closed distributor with a straight exterior surface, the exterior surface terminating, at the upper peripheral edge of the cap and at the lower peripheral edge of the body, the lower peripheral edge being a lower edge of the straight body lateral skirt, and the upper peripheral edge being an upper edge of the straight cap lateral skirt and having substantially the same width as the width of said lower peripheral edge.

2. The distributor of claim 1, wherein, the body (2) and the cap (5) are molded together as a single piece.

3. The distributor of claim 1, wherein, the body comprises, as a molded part thereof, the attachment parts (8) for attaching the product (7) to the body.

4. The distributor of claim 1, wherein, the closing element (6, 60, 600) is inserted into the orifice and is a molded part (600) of the body.

5. The distributor of claim 1, wherein, the closing element (6, 61) is one of a lid and a sealed tape covering the orifice.

6. The distributor of claim 1, wherein, the product volume is defined by, at the upper end by the inner surface of the dome of the cap, at the lower end by the inner surface of the bottom of the body, and at sidewall surfaces by the inner sidewall surface of the body lateral skirt and an inner sidewall surface of the cap lateral skirt, the inner sidewall surface of the cap lateral skirt extending the inner surface of the body.

7. The distributor of claim 1, wherein, with the cap solidarisation edge joined to the body solidarisation edge, the body is joined to the cap and forms the closed distributor with the straight cylindrical exterior surface, the exterior surface terminating, at the upper peripheral edge, with an upper horizontal edge surface of the first wall thickness, and the exterior surface terminating, at a lower peripheral edge, with a lower horizontal edge surface of the first wall thickness, the lower horizontal edge surface being the lower edge of the straight body lateral skirt, and the upper horizontal edge surface being the upper edge of the straight cap lateral skirt (52).

8. The distributor of claim 7, wherein, the closed distributor is stackable, at the lower and upper horizontal edge surfaces, to form stacked distributors with an extended cylindrical exterior surface of the constant exterior diameter.

9. The distributor of claim 1, wherein, the produce volume space is between 2 and 50 $cm^3$.

10. The distributor of claim 1, wherein, a cap volume portion (V1) is within 30% to 300% a body volume portion (V2).

11. The distributor of claim 1, wherein, the cap lateral skirt (52) is of the first wall thickness.

12. The distributor of claim 1, wherein, the body solidarisation edge and the cap solidarisation edge are one of a click fitting, a sliding fitting, a screwed fitting, and a threaded edge fitting.

13. The distributor of claim 1, wherein, the body (2) and the cap (5) are molded together as a single piece and connected by a flexible connecting tab (51) making the cap (5) integral to the body (2).

14. The distributor of claim 1, wherein, the closing element is one of a glued seal, a heat-sealed disc, a closing cap, and a non-return valve.

15. The distributor of claim 1, wherein, the bottom of the body is one of a straight plane, a convex surface, and a concave surface.

16. The distributor of claim 1, wherein, a height of the inner sidewall surface of the body lateral skirt is unequal to a height of the inner sidewall surface of the cap lateral skirt.

17. The distributor of claim 1, wherein, a height of the inner sidewall surface of the body lateral skirt is equal to a height of the inner sidewall surface of the cap lateral skirt.

18. The distributor of claim 1, wherein, a height of the inner sidewall surface of the body lateral skirt is non-zero and a height of the inner sidewall surface of the cap lateral skirt is zero.

19. The distributor of claim 1, wherein, the dome of the cap is, a concave surface, as seen from the product volume space.

20. The distributor of claim 1, wherein, the attachment parts (8) are formed by one of outgrowths (82, 83) extending the body (2), by outgrowths (84) extending from the closing element (6), and by an insert (81) molded integral to the body.

21. The distributor of claim 20, wherein, the outgrowths (82, 83, 84) further comprise attachment tabs (80).

22. The distributor of claim 21, wherein, the attachment tabs (80) are rigid.

23. The distributor of claim 1, wherein, the attachment element is a mesh (85) molded integrally with the body.

24. Distributor (1) for offering a sample of a solid, semi-solid or pasty product (7) at ambient temperature, comprising:

a body (2) molded to a cap (5) as a single piece, the body having i) a orifice (40) located at a bottom of the body, ii) a straight body lateral skirt (3), of a first wall thickness, terminating at an upper end with a body solidarisation edge (20), and iii) a lower peripheral edge (220), the cap (5) having i) a dome (53), ii) a straight cap lateral skirt (52) terminating at a lower end with a cap solidarisation edge (50), and iii) an upper peripheral edge (540), the cap solidarisation edge, when joined, cooperating with the body solidarisation edge to jointly form a wall thickness equal to the first wall thickness of the body, the body lateral skirt and the cap lateral skirt, when joined, cooperating to provide a closed distributor with a straight external wall surface free of external protrusions;

a cavity located within the cap attached to the body, the cavity providing a product volume (V), the product volume being defined by, at an upper end by an inner surface (57) of the dome of the cap, at a lower end by an inner surface (67) of the bottom of the body, and at straight cylindrical internal sidewall surfaces (520, 36), by an inner sidewall surface of the body lateral skirt and any inner sidewall surface of the cap lateral skirt, the body comprising attachment means (8) for attaching the product (7) to the body; and a closing element (6) closing the orifice to retain the product within the cavity, the closing element being one of a insert (6, 60, 63) inserted into the cavity and a cover (6, 61) covering the orifice, wherein, with the cap solidarisation edge joined to the body solidarisation edge, the body is joined to the cap and forms the closed distributor with a straight exterior surface, the exterior surface terminating, at the upper peripheral edge of the cap and at the lower peripheral edge of the body, the lower peripheral edge being a lower edge of the straight body lateral skirt, and the upper peripheral edge being an upper edge of the straight cap lateral skirt and having substantially the same width as the width of said lower peripheral edge.

* * * * *